US007028453B2

(12) United States Patent
Nishimura

(10) Patent No.: US 7,028,453 B2
(45) Date of Patent: Apr. 18, 2006

(54) HORSE BIT

(75) Inventor: Keizo Nishimura, Kobe (JP)

(73) Assignee: Action Japan, Inc., Kobe (JP)

( * ) Notice: Subject to any disclaimer, the term of this patent is extended or adjusted under 35 U.S.C. 154(b) by 0 days.

(21) Appl. No.: 10/887,584

(22) Filed: Jul. 9, 2004

(65) Prior Publication Data

US 2005/0034434 A1 Feb. 17, 2005

Related U.S. Application Data

(63) Continuation-in-part of application No. 29/201,597, filed on Mar. 16, 2004, and a continuation-in-part of application No. 29/186,628, filed on Jul. 17, 2003.

(51) Int. Cl.
*B68B 1/06* (2006.01)

(52) U.S. Cl. ..... 54/9

(58) Field of Classification Search ..... 54/7–9
See application file for complete search history.

(56) References Cited

U.S. PATENT DOCUMENTS 3,851,446 A * 12/1974 Bischeltsrieder ..... 54/8
4,005,564 A * 2/1977 Simington ..... 54/8
5,357,735 A * 10/1994 Fry ..... 54/9
6,324,821 B1 * 12/2001 Bauer et al. ..... 54/9
6,449,930 B1 * 9/2002 Robart et al. ..... 54/8
2002/0139094 A1 * 10/2002 Jonsson ..... 54/7

OTHER PUBLICATIONS

Reitsport Waldhausen, Alles Gue Für Ihr Pferd: Riding to the Future, pp. 89-105, Germany, 2004.

* cited by examiner

*Primary Examiner*—Son T. Nguyen
(74) *Attorney, Agent, or Firm*—Alleman Hall McCoy Russell & Tuttle LLP

(57) ABSTRACT

A horse bit is disclosed, including a pair of right and left mouthpieces, a joint shaft member extending in a longitudinal direction of the mouthpieces and configured to join the mouthpieces, and cheeks, respectively provided substantially on outer ends of the mouthpieces and configured to respectively connect reins to the mouthpieces, wherein the mouthpieces are each rotatable around the joint shaft member, and the joint shaft member is divided into right and left shaft elements at an intermediate portion thereof, and eye bolts corresponding to the right and left shaft elements are rotatable toward the intermediate portion.

18 Claims, 15 Drawing Sheets

HORSE BIT

CROSS-REFERENCE TO RELATED APPLICATIONS

This application is a continuation-in-part of U.S. patent application Ser. No. 29/186,628, filed Jul. 17, 2003, entitled HORSE BIT WITH JOINT PORTION, and of U.S. patent application Ser. No. 29/201,597, filed Mar. 16, 2004, entitled JOINT PORTION OF A MOUTH BIT. The entire disclosure of each of these applications is herein is incorporated by reference for all purposes.

BACKGROUND OF THE INVENTION

1. Field of the Invention

The present invention relates to a horse bit for use with a horse to connect reins to the mouth of the horse to control the horse in horse riding.

2. Description of the Related Art

A conventionally known horse bit includes a pair of right and left metal shafts (also referred to as mouthpieces) having one end portions joined to each other, and metal rings (also referred to as cheeks) mounted to opposite end portions of these mouthpieces and connected with reins. The one end portions of the mouthpieces are ring-shaped. The mouthpieces are coupled to each other by the ring-shaped portions. Specifically, the pair of mouthpieces are coupled in such a manner that one ring is coupled to the other ring like a chain to form interlocking rings. The cheeks are rotatably inserted into holes formed in the opposite end portions of the mouthpieces.

The horse bit having the mouthpieces coupled by the interlocking rings is advantageous, because its construction is simple. But, the mouthpieces coupled by the interlocking rings do not move freely relative to each other. In addition, during use, the interlocking rings make contact and emit a noise. This may cause the horse to get nervous.

SUMMARY OF THE INVENTION

In accordance with the present invention, a horse bit featured by a joint mechanism configured to join mouthpieces to each other is provided.

According to one aspect of the present invention, there is provided a horse bit comprising two mouthpieces, a joint shaft member extending in a longitudinal direction of the mouthpieces and configured to join the mouthpieces, and rein-connecting members, respectively provided substantially on outer ends of the mouthpieces and configured to respectively connect reins to the mouthpieces, wherein the mouthpieces are each rotatable around the joint shaft member, and the joint shaft member is divided into right and left shaft elements at an intermediate portion thereof, and the right and left shaft elements are rotatable toward the intermediate portion.

According to another aspect of the present invention, there is provided a horse bit comprising a pair of right and left outer mouthpieces, at least one intermediate mouthpiece disposed between the outer mouthpieces, a joint shaft member extending in a longitudinal direction of the mouthpieces and configured to join the mouthpieces, and rein-connecting members provided substantially on outer ends of the mouthpieces and configured to respectively connect reins to the mouthpieces, wherein the mouthpieces are each rotatable around the joint shaft member, and the joint shaft member is divided into right and left shaft elements at an intermediate portion thereof, and the shaft elements are rotatable toward the intermediate portion.

Each of the shaft elements may include a shaft portion and a joint portion formed at one end portion of the shaft portion, the shaft portion may be mounted to the mouthpiece to be rotatable around an axis thereof, and joint portions of the shaft elements may be coupled to each other such that the shaft elements are rotatable toward the joint portion.

The horse bit may further comprise a joint pin member, wherein each of the joint portions may include a ring-shaped portion, and the shaft elements may be rotatable around the pin member inserted substantially coaxially into the ring-shaped portions.

The joint portions of the shaft elements may be coupled to form a substantially spherical shape.

In order to form the joint portions in the spherical shape, the joint portions may further include a pair of semispherical shells joined into a substantially spherical shell, and the semispherical shells may be coupled by the pin member inserted substantially coaxially into the ring-shaped portions with the ring-shaped portions stored within the semispherical shells.

Instead of providing the semispherical shells, the joint portion may be semispherical.

Each of the shaft elements may include an eye bolt and a nut, and the mouthpiece has an inner cavity extending in an axial direction thereof, and the inner cavity may include a bolt storage bore into which the eye bolt is rotatably inserted, and a nut storage bore extending continuously with the bolt storage bore and away from the joint portion and configured to store the nut screwed to the bolt, the nut storage bore having a diameter larger than a diameter of the bolt storage bore.

In order to facilitate mounting the nut to the eye bolt, each of the mouthpieces may be formed by two members coupled in the vicinity of a boundary between the bolt storage bore and the nut storage bore.

In a horse bit comprising three or more mouthpieces, to facilitate mounting the nut to the eye bolt, the intermediate mouthpiece may be formed by three members joined in the vicinity of a boundary between the bolt storage bore and the nut storage bore.

To facilitate mounting the nut to the eye bolt, likewise, the intermediate mouthpiece may be formed by two members joined in the nut storage bore.

The above and further objects and features of the invention will be more fully be apparent from the following detailed description with accompanying drawings.

DETAILED DESCRIPTION OF THE EMBODIMENTS

Figure 3:
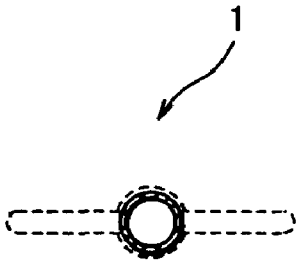
FIG. 3 is a right side view of the joint portion of the embodiment of FIG. 1, showing a contour of a cross-section of the joint portion. The left side view is a mirror image of the right side view, so the left side view has been omitted.

Hereinafter, embodiments of the horse bit of the present invention will be described with reference to the accompanying drawings.

FIGS. 1 to 6 show a horse bit 1. FIGS. 7 to 12 show another horse bit 2. FIGS. 13 to 18 show another horse bit 3. FIG. 19 to 23 show another horse bit 4. Each of the horse bits 1, 2, and 3 has a pair of right and left shafts (mouthpieces) 5, 6, or 7. Each of the horse bits 4 has three mouthpieces 8 and 9 coupled in series.

Figure 1:
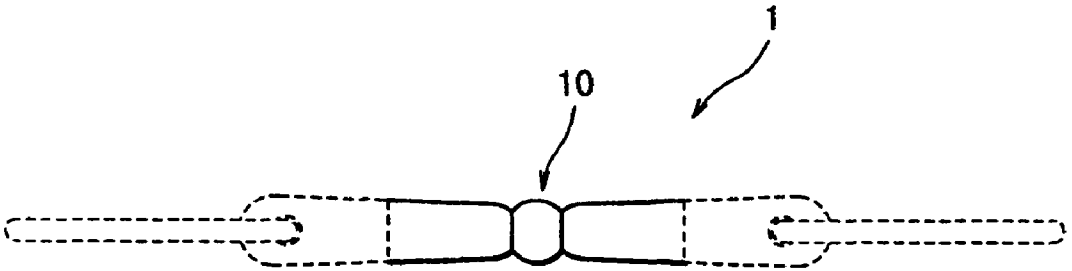
FIG. 1 is a front view of a joint portion of a horse bit, according to one embodiment of the present invention. The back view is a mirror image of the front, so the back view has been omitted.
Figure 2:
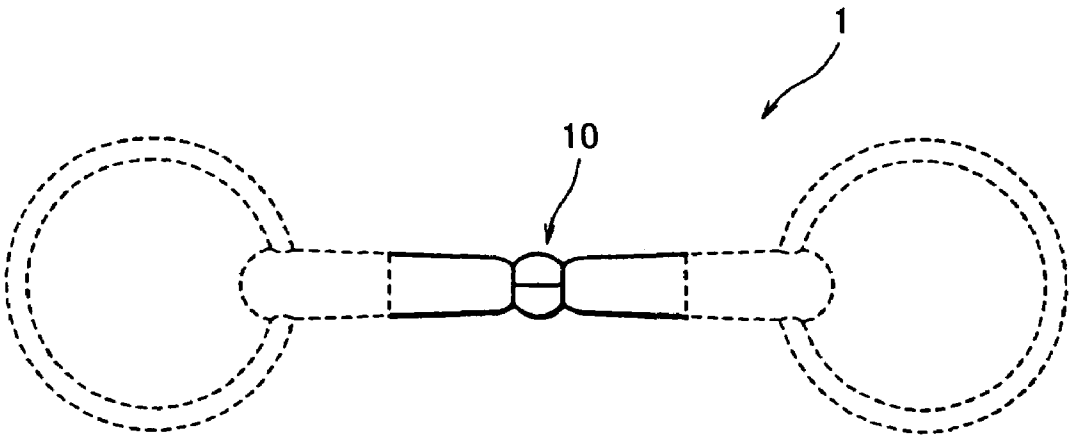
FIG. 2 is a top view of the joint portion of the embodiment of FIG. 1, showing a ball swivel joint configured to rotate into the page. The bottom view is a mirror image of the top view, so the bottom view has been omitted.
Figure 6:
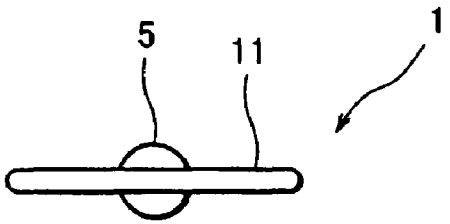
FIG. 6 is a right side view of the horse bit of FIG. 4. The left side view is a mirror image of the right side view, so the left side view has been omitted.
Figure 4:
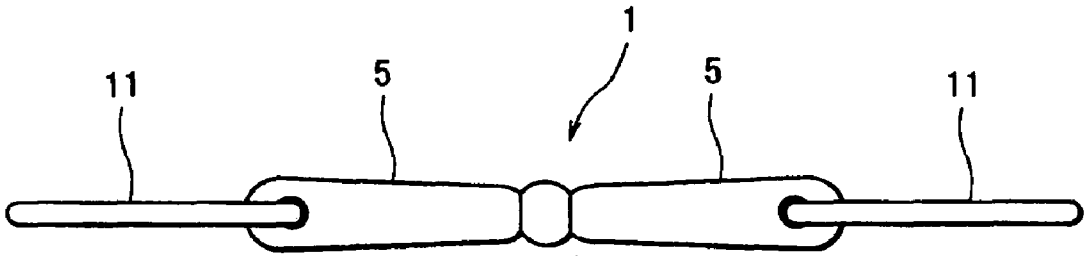
FIG. 4 is a front view of a horse bit, according to another embodiment of the present invention. The back view is a mirror image of the front view, so the back view has been omitted.
Figure 5:
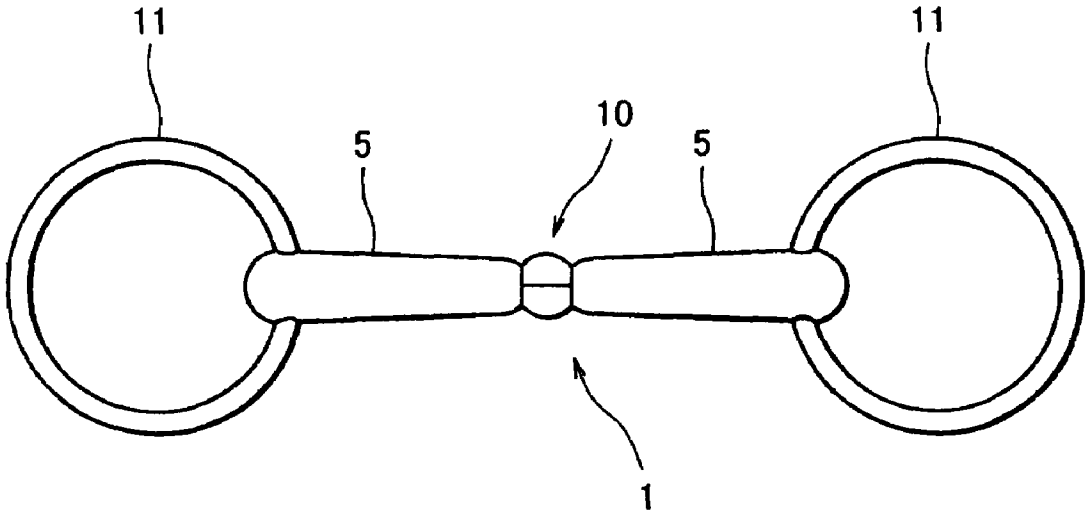
FIG. 5 is a top view of the horse bit of FIG. 4. The bottom view is a mirror image of the top view, so the bottom view has been omitted.
Figure 9:
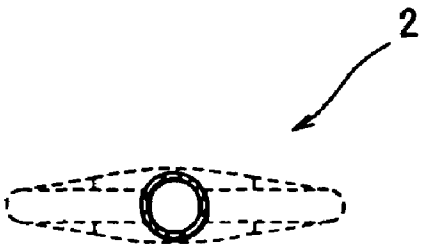
FIG. 9 is a right side view of the joint portion of the embodiment of FIG. 7, showing a contour of a cross-section of the joint portion. The left side view is a mirror image of the right side view, so the left side view has been omitted.
Figure 7:
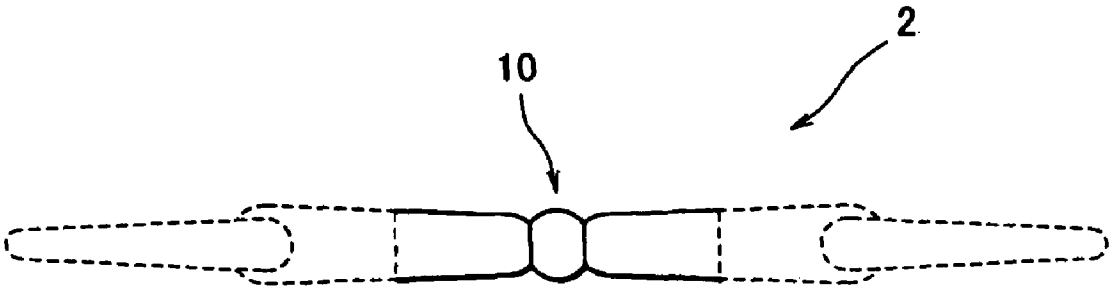
FIG. 7 is a front view of a joint portion for a horse bit, according to another embodiment of the present invention. The back view is a mirror image of the front view, so the back view has been omitted.
Figure 8:
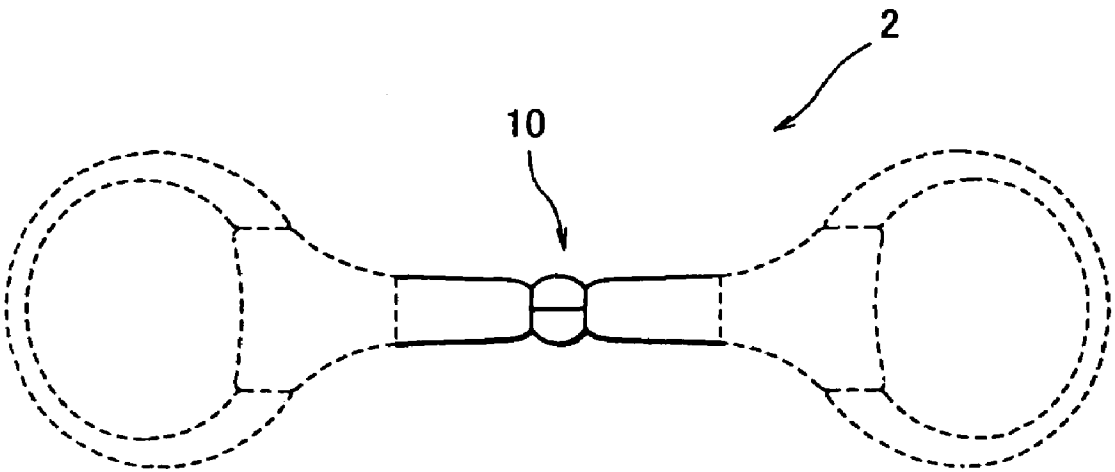
FIG. 8 is a top view of the joint portion of the embodiment of FIG. 7, showing a ball swivel joint configured to rotate into the page. The bottom view is a mirror image of the top view, so the bottom view has been omitted.
Figure 12:
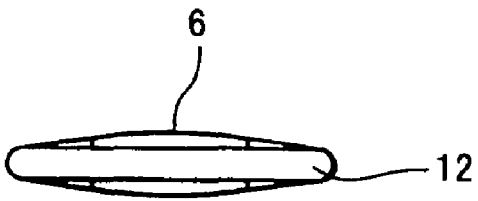
FIG. 12 is a right side view of the horse bit of FIG. 10. The left side view is a mirror image of the right side view, so the left side view has been omitted.
Figure 10:
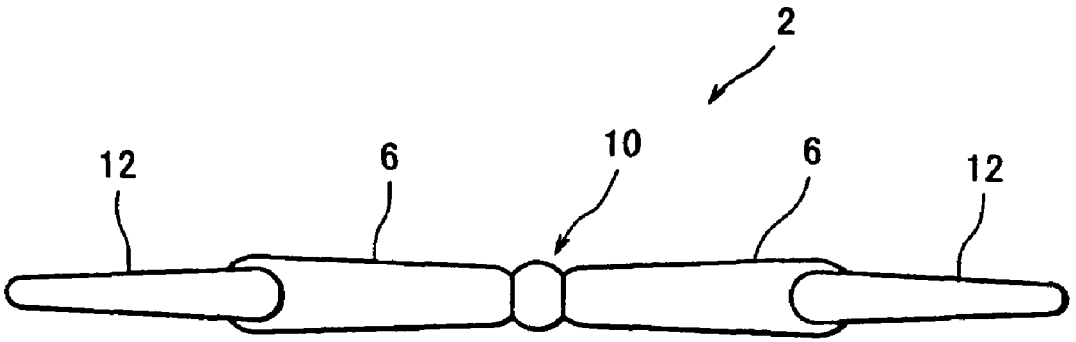
FIG. 10 is a front view of a horse bit, according to another embodiment of the present invention. The back view is a mirror image of the front view, so the back view has been omitted.
Figure 11:
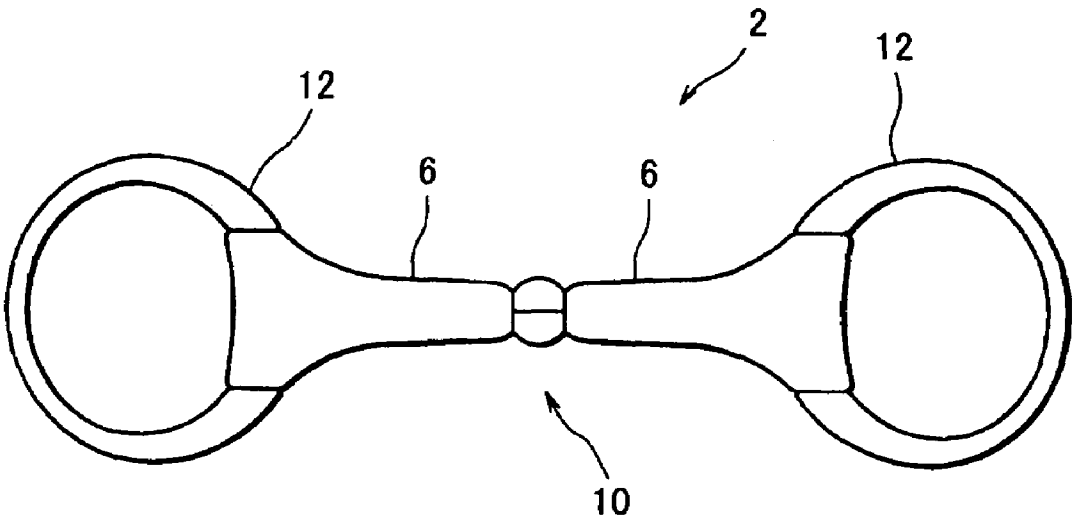
FIG. 11 is a top view of the horse bit of FIG. 10. The bottom view is a mirror image of the top view, so the bottom view has been omitted.
Figure 15:
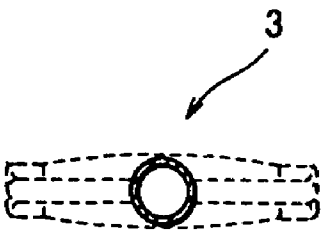
FIG. 15 is a right side view of the joint portion of the embodiment of FIG. 13, showing a contour of a cross-section of the joint portion. The left side view is a mirror image of the right side view, so the left side view has been omitted.
Figure 13:
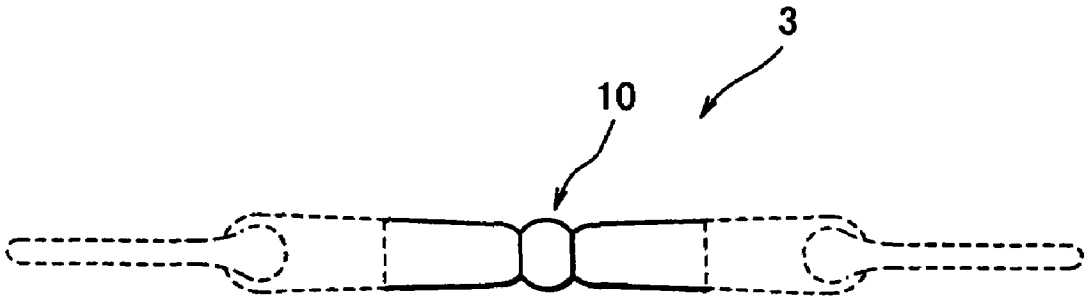
FIG. 13 is a front view of a joint portion for a horse bit, according to another embodiment of the present invention. The back view is a mirror image of the front view, so the back view has been omitted.
Figure 14:
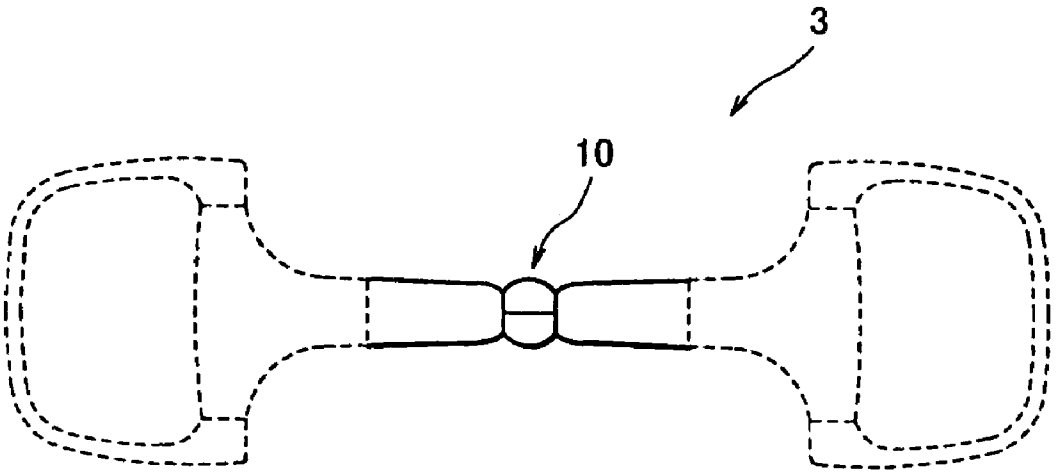
FIG. 14 is a top view of the joint portion of the embodiment of FIG. 13, showing a ball swivel joint configured to rotate into the page. The bottom view is a mirror image of the top view, so the bottom view has been omitted.
Figure 18:
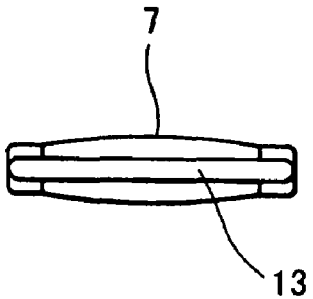
FIG. 18 is a right side view of the horse bit of FIG. 16. The left side view is a mirror image of the right side view, so the left side view has been omitted.
Figure 16:
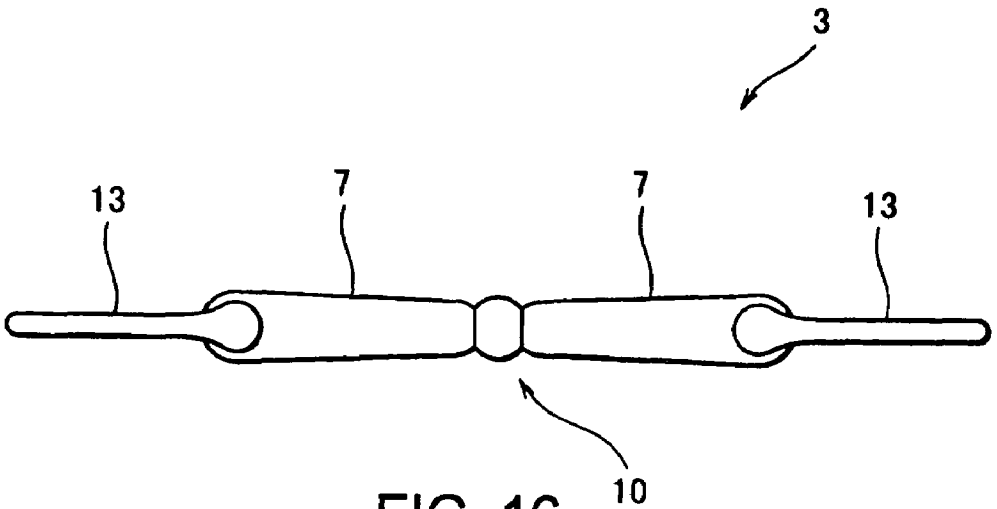
FIG. 16 is a front view of a horse bit, according to another embodiment of the present invention. The back view is a mirror image of the front view, so the back view has been omitted.
Figure 17:
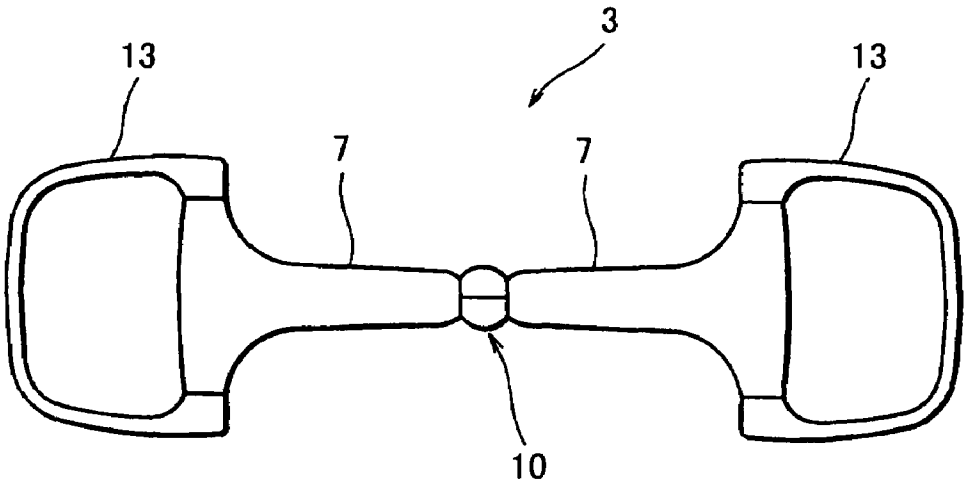
FIG. 17 is a top view of the horse bit of FIG. 16. The bottom view is a mirror image of the top view, so the bottom view has been omitted.

FIGS. 1 and 2 show a joint portion 10 of the horse bit 1. FIGS. 7 and 8 show a joint portion 10 of the horse bit 2. FIGS. 13 and 14 show a joint portion 10 of the horse bit 3. These joint portions 10 are ball swivel joints having the same external appearance and structure as described later. On the other hand, vicinities of end portions of the mouthpieces 5, 6, and 7 which are on the opposite side of the joint portions 10 are different in shape from one another, and rings (cheeks) 11, 12, and 13 connected with reins are different in shape from one another. This will be described later.

The cheeks 11, 12, and 13 are respectively rotatably mounted to the end portions of the mouthpieces 5, 6, and 7 on the opposite side of the joint portions 10. The pair of mouthpieces 5 (or 6 or 7) are rotatable around the joint portion 10. Further, one of the pair of mouthpieces 5 (or 6 or 7) is rotatable around both its own axis and the axis of the other mouth piece.

The horse bit 4 of FIGS. 19 to 23 is constructed such that the pair of right and left outer mouthpieces 8 and the intermediate mouthpiece 9 located between the outer mouthpieces 8 are coupled to one another. Each outer mouthpiece 8 and the intermediate mouthpiece 9 are rotatable around the joint portion 10. Further, the outer mouthpiece 8 and the intermediate mouthpiece 9 are each rotatable around both its own axis and the axis of the opposing mouthpiece. This will be described later.

Figure 24:
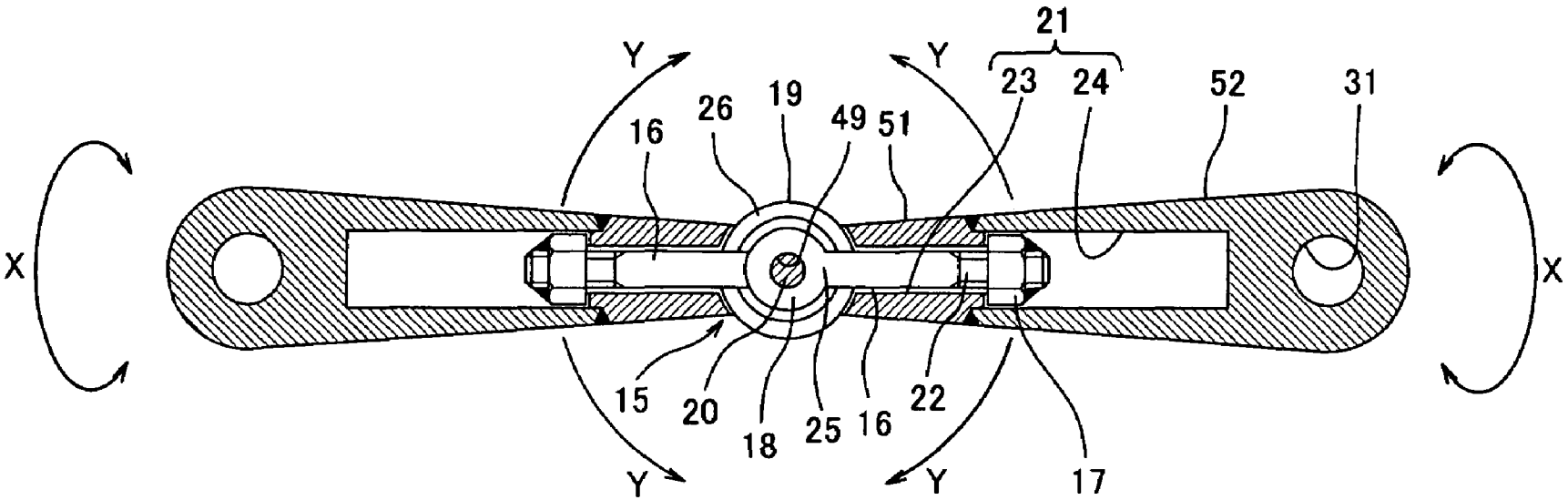
FIG. 24 is a cross-sectional view of the horse bit of FIG. 4.

FIG. 24 shows the horse bit 1 constructed such that the pair of right and left mouthpieces 5 are jointed by a joint shaft member 15. Turning to FIGS. 24, 25, 26, and 27, the joint shaft member 15 includes, as joint elements, two eye bolts 16, nuts 17 screwable to the two eye bolts 16, a pair of semispherical shells 19 configured to store eye portions 18 of the eye bolts 16, and a pin 20 configured to couple the pair of semispherical shells 19 and the eye portions 18 of the eye bolts 16. The joint portion 10 includes the eye portions 18, and the semispherical shells 19.

Each mouthpiece 5 is provided with a bore (cavity) 21 extending in an axial direction thereof. The bore 21 has a bottom. The eye bolt 16 is mounted in the bore 21. The bore 21 has a bolt storage bore 23 through which a shaft portion (bolt portion) 22 of the eye bolt 16 is inserted, and a nut storage bore 24 extending continuously with the bolt storage bore 23 and away from the joint portion 10 to allow the nut 17 to be stored therein. The mouthpiece 5 is a unitary piece formed by welding a bolt storage member 51 provided with the bolt storage bore 23 to a base member 52 provided with the nut storage bore 24. Instead of welding, the bolt storage member 51 and the base member 52 may be coupled by a screw. A mounting hole 31 in which the cheek 11 is mounted is formed in an end portion of each base member 52.

When the joint shaft member 15 is assembled, the bolt portion 22 of the eye bolt 16 is inserted into the bolt storage bore 23 of the bolt storage member 51, and the nut 17 is screwed to and welded to the bolt portion 22. Then, the base member 52 is welded to the end portion of the bolt storage member 51 so that the bolt storage bore 23 and the nut storage bore 24 are coaxially connected. A unitary piece formed by the one mouthpiece piece 5 and the eye bolt 16 and a unitary piece formed by the other mouthpiece 5 and the other eye bolt 6 in the same manner are coupled to each other by the pair of semispherical shells 19 and the pin 20 as described later. A flange 30 which is like a frustum of a cone is formed at one end portion of the pin 20 and has a diameter larger than that of a cross-section of the pin 20.

The eye portion 18 of the eye bolt 16 is flat and circular-disc shaped. The eye portion 18 has a thickness approximately half the diameter of the cross-section of the bolt portion 22. The eye portion 18 has a diameter approximately 1.6 times as large as that of the cross-section of the bolt portion 22. These sizes are only illustrative. A neck portion 25 is formed between and continuously with the eye portion 18 and the bolt portion 22. The neck portion 25 has a thickness substantially equal to that of the eye portion 28 and has a width approximately equal to the diameter of the bolt portion 22.

The semispherical shell 19 has a diameter larger than that of the eye portion 18. A cylindrical concave portion 27 is formed concentrically on a circular flat portion 26 of the semispherical shell 19 to allow the eye portion 18 to be stored therein. The concave portion 27 has a depth slightly larger than the thickness of the eye portion 18. A groove 28 is formed to extend continuously with the concave portion 27 to allow the concave portion 27 and the outside of the semispherical shell 19 to communicate with each other therethrough. The groove 28 has a depth approximately equal to that of the concave portion 27. The groove 28 serves to store the neck portion 25 of the eye bolt 16 therein and, therefore, the width thereof is slightly larger than that of the neck portion 25. A bore 29 is formed at the center of the concave portion 27 to extend through the semispherical shell 19 to allow the pin 20 to be inserted therein. The bore 29 has an opening on the semispherical surface side formed by countersinking. And, an end face of the mouthpiece 5 on the joint portion 10 side has concavity formed by a part of a spherical face that conforms in shape to a spherical face formed by joining the pair of semispherical shells 19.

Figure 25:
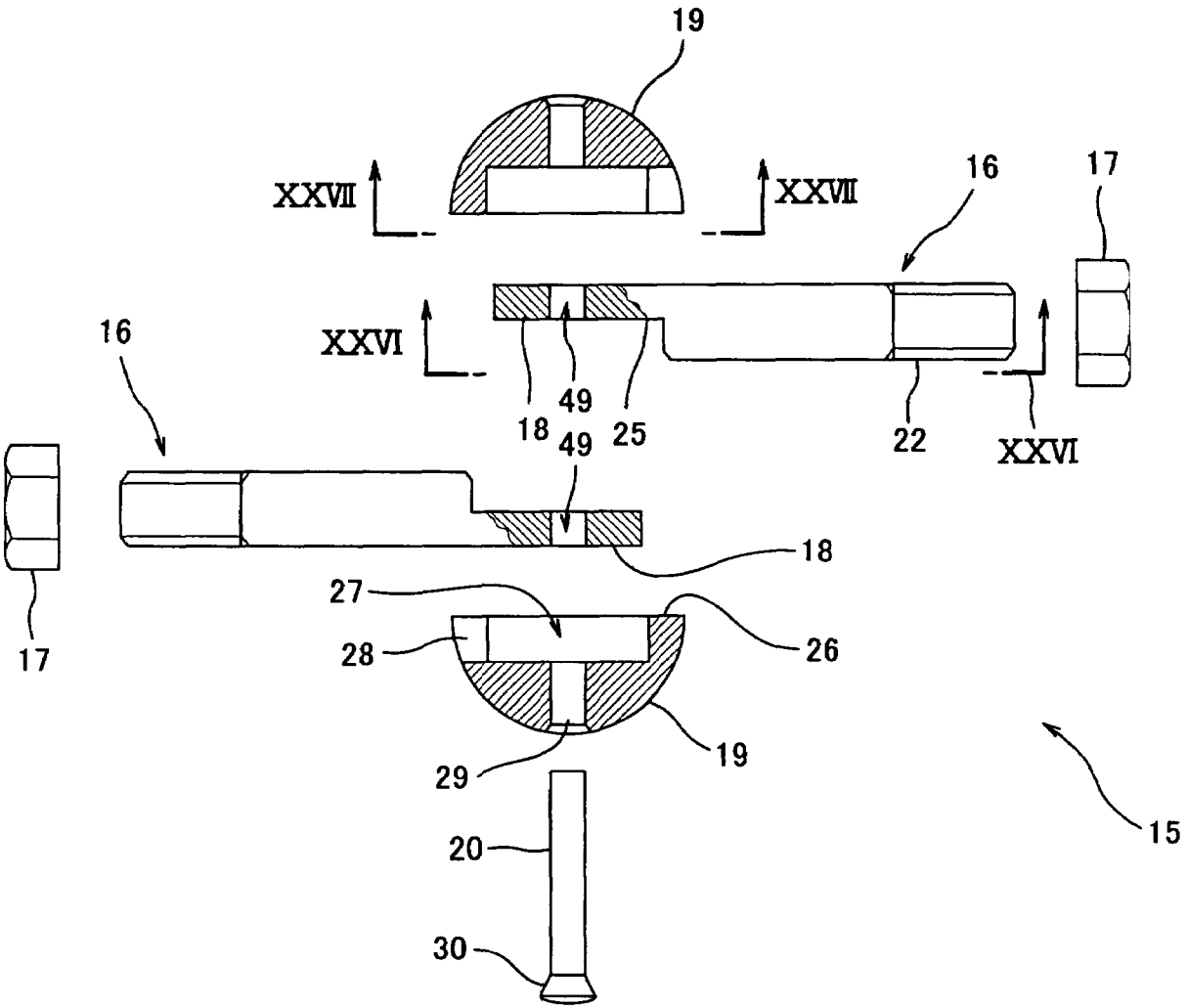
FIG. 25 is a partial cross-sectional view of a shaft member of FIG. 24 before assembly.

When the pair of mouthpieces 5 are coupled, as shown in FIG. 25, the eye portions 18 of the eye bolts 18 mounted to the mouthpiece pieces 5 are overlapped with each other, and then the pair of semispherical shells 19 cover the eye portions 18 from the outside. Next, the bores 49 of the eye portions 18 are made to coincide with the bores 29 of the semispherical shells 19. Then, the pin 20 is inserted into the bores 49 of the eye portions 18 and the bores 29 of the semispherical shells 19 until the flange 30 of the pin 20 contacts one of the semispherical shells 19 and the pin 20 thereby stops. In this state, an end portion of the pin 20 on the opposite side of the flange 30 is welded to the other semispherical shell 19, or struck to cause its diameter to increase, thereby inhibiting the pin 20 from coming off the semispherical shells 19.

Figure 28:
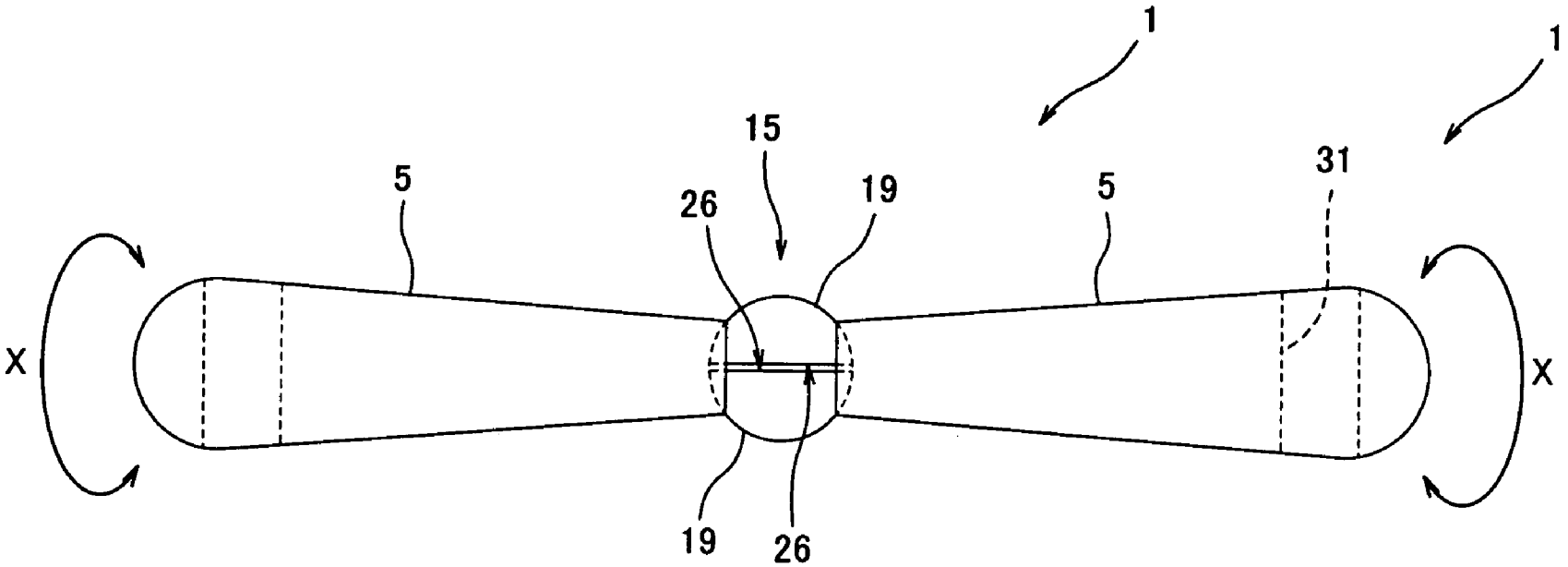
FIG. 28 is a plan view of mouthpieces and a joint portion of the horse bit of FIG. 5.

The pair of mouthpieces 5 so coupled by the joint shaft member 15 are, as shown in FIG. 24, rotatable around the center axis of the joint shaft member 15 as indicated by an arrow X in FIGS. 24 and 28. Further, the pair of mouthpieces 5 are rotatable around the pin 20 of the joint shaft member 15 as indicated by an arrow Y in FIG. 24. Therefore, as described above, the joint portion 10 forms the ball swivel joint. That is, one mouthpiece 5 is rotatable around the pin 20 freely relative to the other mouthpiece 5. And, the joint shaft member 15 is rotatable around its center axis relative to the mouthpieces 5 such that substantially no rotational force is transferred between the mouthpiece 5 and the joint shaft member 15. In addition, during use, the horse can enjoy rolling a spherical portion of the joint shaft member 15 on its tongue.

During use, emission of noises may be inhibited by reducing the clearance or play between parts; for example, by reducing the clearance between an inner peripheral face of the bolt storage bore 23 of the mouthpiece 5 and an outer peripheral face of the bolt portion 22 of the eye bolt 16, by reducing the difference between an axial length of the bolt storage bore 23 and a distance between the nut 17 and the semispherical shell 19 by adjusting the position of the nut 17 relative to the eye bolt 16, by reducing a spacing between the circular flat portions 26 of the semispherical shells 19 after assembly, or by reducing the difference between the diameter of the cross-section of the pin 20 and the diameter of the bore 49 of the eye portion 18 and the diameter of the bore 29 of the semispherical shell 19.

Figure 29:
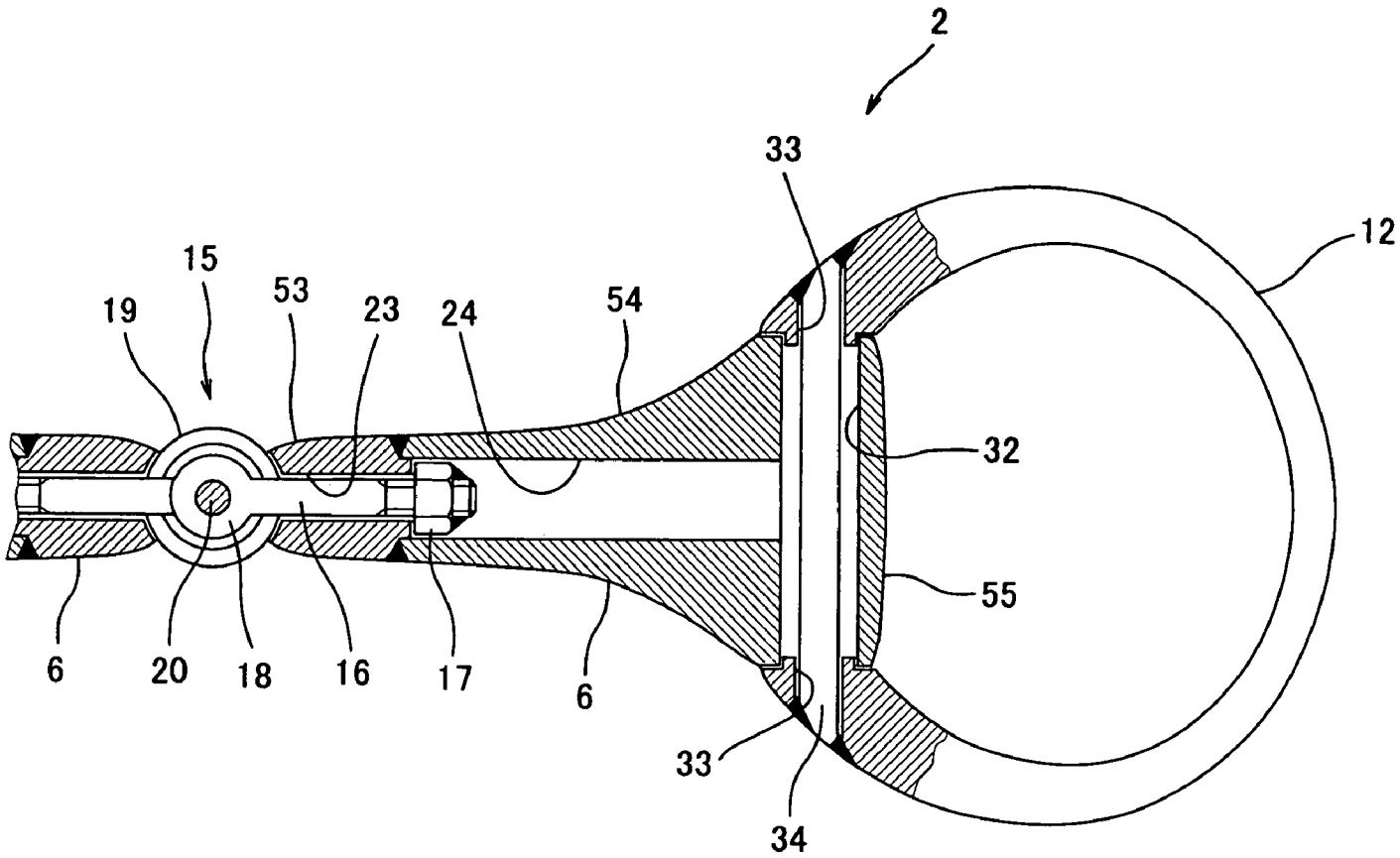
FIG. 29 is a partial cross-sectional front view of the horse bit of FIG. 10.

FIG. 29 shows an internal structure of the horse bit 2 of FIGS. 7 to 12. As described above, vicinities of end portions of the mouthpiece 6 of the horse bit 2, which are on the opposite side of the joint portion 10, are different in shape from those of the horse bit 1 of FIGS. 1 to 6, 24, and 28. The mouthpiece 6 is a unitary piece formed by welding a bolt storage member 53 provided with the bolt storage bore 23 to a base member 54 provided with the nut storage bore 24. Instead of welding, the bolt storage member 53 and the base member 54 may be coupled by a screw. The bolt storage member 53 has substantially the same shape and structure as those of the bolt storage member 51 of the mouthpiece 5 of the horse bit 1. And, the joint shaft member 15 has substantially the same shape and structure as those of the shaft member 15 of the horse bit 1. Specifically, the joint shaft member 15 includes the eye bolts 16, the nuts 17, the semispherical shells 19, and the pin 20 of FIG. 25. With the eye bolt 16 inserted into the bolt storage member 53 to be rotatable around its center axis, the nut 17 is screwed to and welded to the eye bolt 16. The eye portions 18 of the eye bolts 16 are coupled to be rotatable by the pair of semispherical shells 19 and the pin 20.

The mouthpiece 6 is entirely T-shaped and differs from the I-shaped mouthpiece 5 of the horse bit 1. A hole 32 is formed on a rod-shaped portion 55 of the T-shaped base member 54 which extends in the direction perpendicular to a center axis of the nut storage bore 24 and configured to extend along a center axis of the rod-shaped portion 55. The cheek 12 of the horse bit 2 is pivotally mounted in the hole 32. The cheek 12 is entirely C-shaped. As shown in FIG. 29, both ends of the cheek 12 are fitted in the hole 32. Holes 33 are formed on both ends of the cheek 12 to be coaxial with the hole 32 with the cheek 12 fitted in the hole 32. A shaft 34 is inserted into the holes 33 of the cheek 12 and the hole 32 of the mouthpiece 6. Both ends of the shaft 34 are welded to a peripheral edge of the holes 33 of the cheek 12. In this structure, the cheek 12 is pivotable around the center axis of the hole 32 of the mouthpiece 6.

Figure 19:
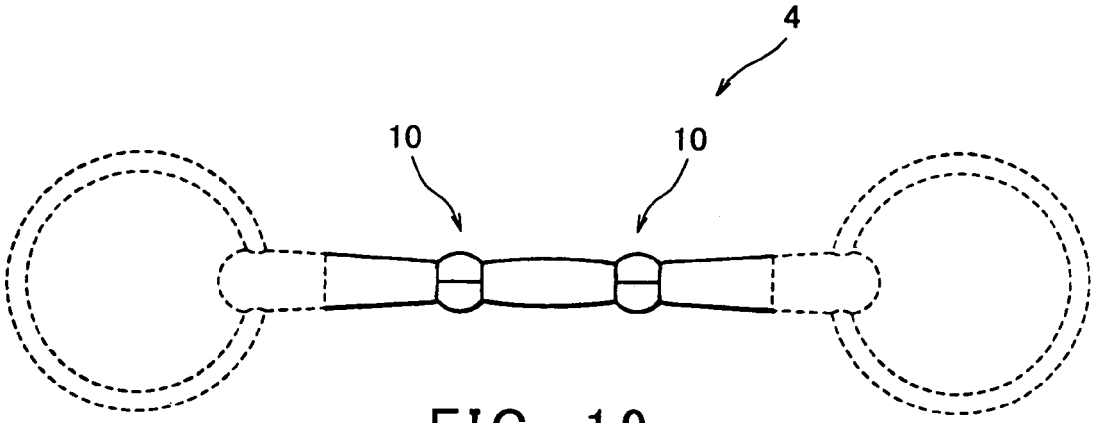
FIG. 19 is a front view of a joint portion of a mouth bit for use with horses, according to another embodiment of the present invention, showing right and left ball swivel joints connecting a right shaft, intermediate shaft, and left shaft, the ball swivel joints being configured to rotate into the page. The back view is a mirror image of the front. Therefore, the back view has been omitted.
Figure 20:
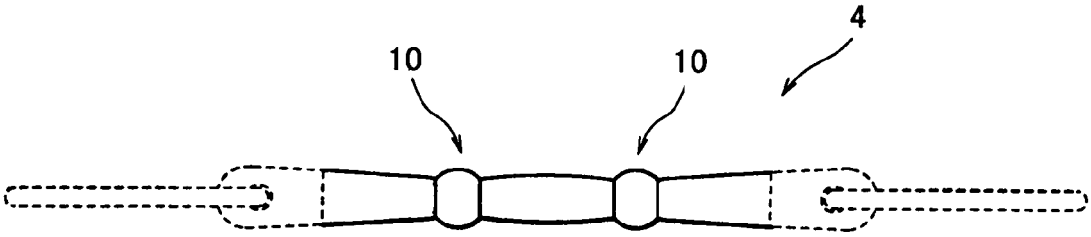
FIG. 20 is a top view of the joint portion of the embodiment of FIG. 19. The bottom view is a mirror image of the top view. Therefore the bottom view has been omitted.
Figure 21:
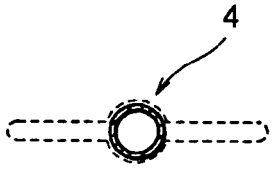
FIG. 21 is a right side view of the joint portion of the embodiment of FIG. 19, showing a contour of a cross-section of the joint portion. The left side view is a mirror image of the right side view. Therefore, the left side view has been omitted.
Figure 22:
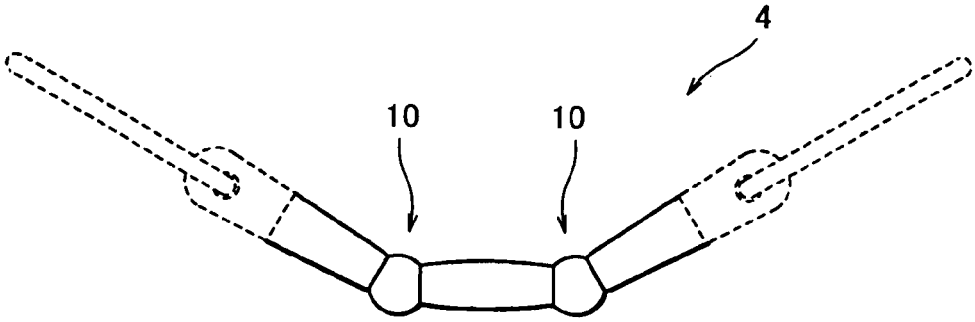
FIG. 22 is a top view of the joint portion of FIG. 19, showing the right shaft and the left shaft of the joint portion bent upward at respective right and left ball swivel joints.
Figure 23:
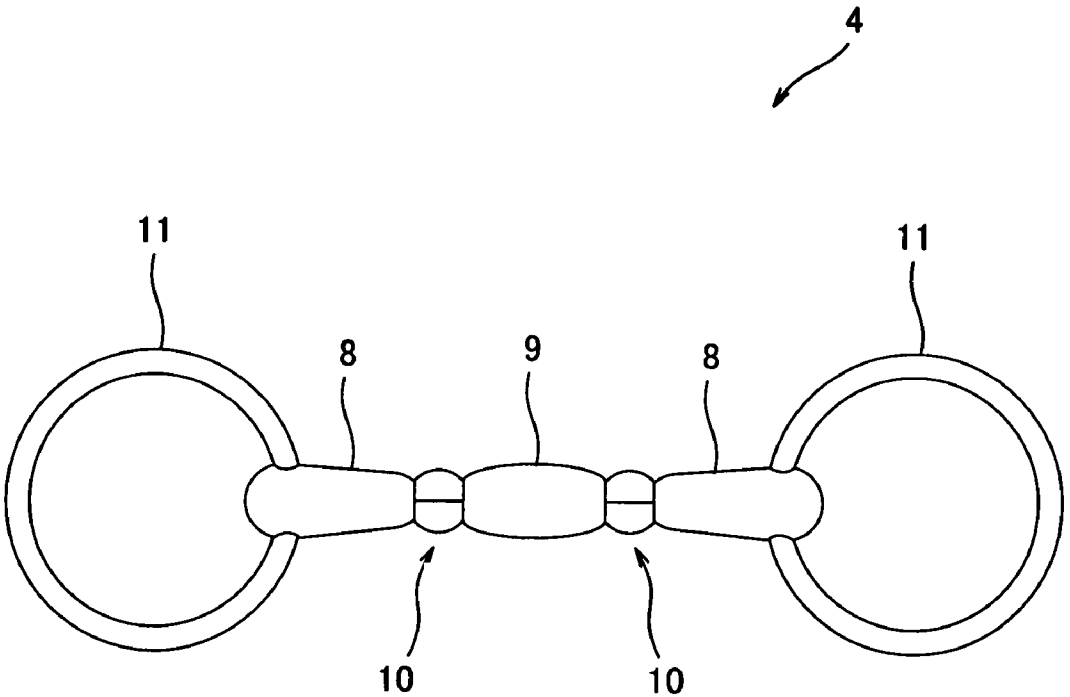
FIG. 23 is a front view of the horse bit of FIG. 19.

The horse bit 3 of FIGS. 13 to 18 is substantially the same as the horse bits 1 and 2 of FIGS. 24 and 19 in shape and structure of the joint shaft member 15 and, therefore, description of the internal structure of the horse bit 3 including the joint shaft member 15 is omitted. But, a cheek 13 of the horse bit 3 differs in shape from the cheek 12 of the horse bit 2 of FIGS. 7 to 12. Specifically, the cheek 13 attached to the T-shaped mouthpiece 7 is substantially D-shaped as shown in FIGS. 13 to 18. A mechanism for mounting the cheek 13 to the mouthpiece 7 is similar to the mechanism for mounting the cheek 12 to the mouthpiece 6 of the horse bit 2 of FIG. 29.

Figure 30:
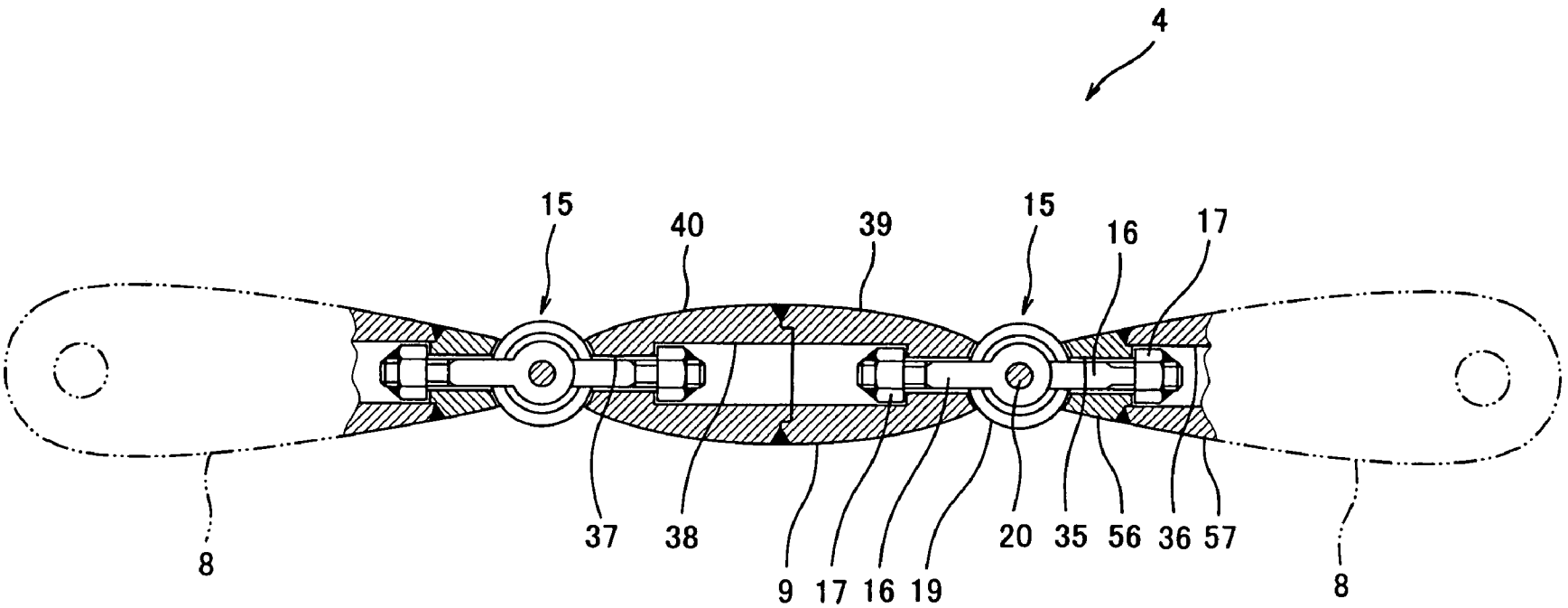
FIG. 30 is a partial cross-sectional front view of joint portions of the horse bit of FIG. 19.

FIG. 30 shows an internal structure of the horse bit 4 of FIGS. 19 to 23. The horse bit 4 includes the pair of right and left outer mouthpieces 8 and the intermediate mouthpiece 9 located between the outer mouthpieces 8. The outer mouthpiece 8 of the horse bit 4 has a shape and structure similar to those of the mouthpiece 5 of the horse bit 1 of FIGS. 1 to 6, and is slightly shorter than the mouthpiece 5 of the horse bit 1. The outer mouthpiece 8 is a unitary piece formed by welding a bolt storage member 56 provided with a bolt storage bore 35 to a base member 57 provided with a nut storage bore 36. A cheek substantially the same as the cheek 11 of FIGS. 1 to 6 is mounted to an end portion of the base member 57.

The joint shaft member 15 coupling the right mouthpiece 8 to the intermediate mouthpiece 9 and the joint shaft member 15 coupling the left mouthpiece 8 to the intermediate mouthpiece 9 have the same shape and structure as those of the joint shaft members 15 of the horse bits 1, 2, and 3. Specifically, the joint shaft member 15 includes the eye bolts 16, the nuts 17, the semispherical shells 19, and the pin 20 of FIG. 25.

As shown in FIG. 30, the intermediate mouthpiece 9 is pipe-shaped. A bore (concavity) is formed in the intermediate mouthpiece 9 to extend along a center axis thereof, and includes bolt storage bores 37 at both ends and a nut storage bore 38 at the center. The intermediate mouthpiece 9 is formed by right and left members 39 and 40 welded into a unitary piece at the center in the longitudinal direction. Instead of welding, the right and left members 39 and 40 may be coupled by a screw. The eye bolt 16 of the joint shaft member 15 is inserted into the bolt storage bore 37 to be rotatable around the center axis, and the nut 17 is screwed to and welded to the eye bolt 16 in the nut storage bore 38. In order to make it easy for the nut 17 to be screwed to the eye bolt 16, the mouthpiece 9 may be formed by three members welded into a unitary piece; more specifically, two outer members provided with the bolt storage bores 37 and having the same shape and structure, and a center member provided with the nut storage bore 38.

Since the eye bolt 16 is mounted to each outer mouthpiece 8 and the eye bolts 16 are coupled by the semispherical shells 19 and the pin 20 in the same manner as in the horse bit 1 as previously described with reference to FIG. 1, this will be omitted.

The outer mouthpieces 8 and the intermediate mouthpiece 9 coupled the joint shaft member 15 are rotatable relative to one another around the center axis of the joint shaft member 15. The mouthpieces 8 and 9 are rotatable around the pin 20 of the joint shaft member 15. Either the joint shaft member 15 or the intermediate mouthpiece 9 is rotatable around its center axis relative to the outer mouthpieces 8 such that substantially no rotational force is transferred between the joint shaft member 15 or the intermediate mouthpiece 9 and the outer mouthpieces 8. In addition, during use, the horse can enjoy rolling the spherical portion of the intermediate mouthpiece 9 on its tongue.

Figure 26:
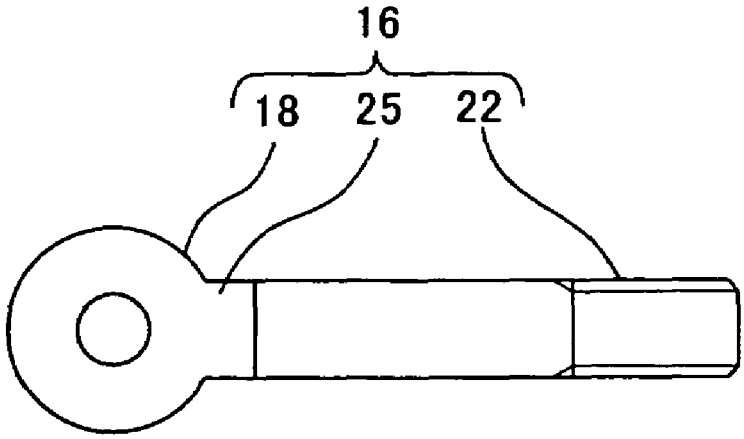
FIG. 26 is a view taken in the direction of arrows along line XXVI—XXVI in FIG. 25.
Figure 27:
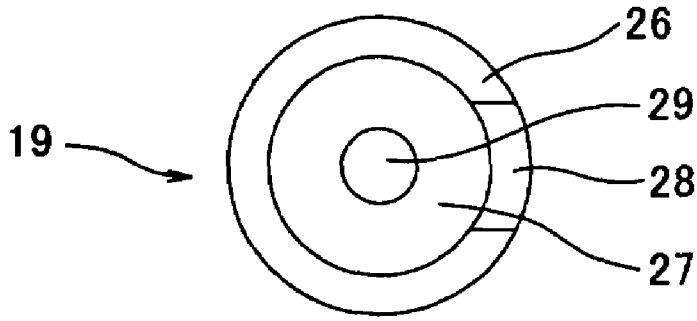
FIG. 27 is view taken in the direction of arrows along line XXVII—XXVII in FIG. 25.
Figure 31:
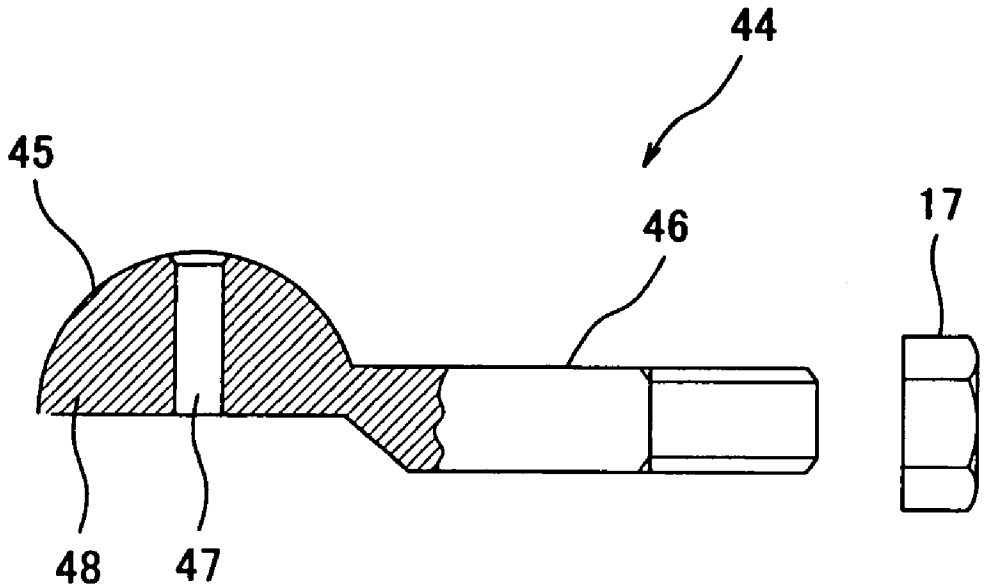
FIG. 31 is a partial cross-sectional view of another embodiment of the joint shaft member.

The joint shaft member 15 of FIGS. 25, 26, and 27 may be replaced by an eye bolt 44 and a nut 17 of FIG. 31. An eye portion 45 of the eye bolt 44 is semispherical. The eye bolt 44 is structured such that the semispherical eye portion 45 is continuous with a bolt portion 46. In this structure, the semispherical shells 19 are omitted. The eye portion 45 is provided with a bore 47 into which the pin 20 is inserted.

The eye bolt 45 is manufactured through, for example, lost-wax process. The use of the eye bolt 45 can reduce parts and increase strength in contrast to the joint shaft member 15. In addition, the eye bolt 44 can decrease the clearance between circular flat portions 48 of the coupled eye portions 45.

The above mentioned mouthpieces 5, 6, 7, 8, and 9 can be manufactured from metal, for example, stainless steel through the lost-wax process, or from high-strength synthetic resin. As thus far described, since the mouthpieces 5, 6, 7, 8, and 9 of the horse bits 1, 2, and 3 are freely rotatable relative to one another, it is possible to inhibit a large load from being applied to the mouth of the horse when a rider tightens the reins.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A horse bit comprising:

two mouthpieces;

a joint shaft member extending in a longitudinal direction of the mouthpieces and configured to join the mouthpieces; and rein-connecting members respectively provided substantially on outer ends of the mouthpieces and configured to respectively connect reins to the mouthpieces, wherein the mouthpieces are each rotatable around the joint shaft member, the joint shaft member is divided into right and left shaft elements at an intermediate portion thereof, and the right and left shaft elements are rotatable toward the intermediate portion, and each of the joint shaft elements includes a shaft portion and a joint portion formed at one end portion of the shaft portion, the shaft portion is mounted to the mouthpiece to be rotatable around an axis thereof, and joint portions of the shaft elements are coupled to each other such that the shaft elements are rotatable toward the joint portion.

2. The horse bit according to claim 1, further comprising:
a joint pin member, wherein
each of the joint portions includes a ring-shaped portion, and
the shaft elements are rotatable around the pin member inserted substantially coaxially into the ring-shaped portions.

3. The horse bit according to claim 2, wherein the joint portions of the shaft elements are coupled to form a substantially spherical shape.

4. The horse bit according to claim 3, wherein the joint portions further include a pair of semispherical shells joined into a substantially spherical shell, and the semispherical shells are coupled by the pin member inserted substantially coaxially into the ring-shaped portions with the ring-shaped portions stored within the semispherical shells.

5. The horse bit according to claim 4, wherein the joint portions are semispherical.

6. The horse bit according to claim 3, wherein each of the shaft elements includes an eye bolt and a nut, and the mouthpiece has an inner cavity extending in an axial direction thereof, and
the inner cavity includes a bolt storage bore into which the eye bolt is rotatably inserted, and a nut storage bore extending continuously with the bolt storage bore and away from the joint portion and configured to store the nut screwed to the bolt, the nut storage bore having a diameter larger than a diameter of the bolt storage bore.

7. The horse bit according to claim 6, wherein each of the mouthpieces is formed by two members coupled in the vicinity of a boundary between the bolt storage bore and the nut storage bore.

8. The horse bit according to claim 1, wherein the mouthpieces are each rotatable relative to the joint shaft member without translational movement of either of the mouthpieces relative to the joint shaft member.

9. A horse bit comprising:
a pair of right and left outer mouthpieces;
at least one Intermediate mouthpiece disposed between the outer mouthpieces;
a joint shaft member extending in a longitudinal direction of the mouthpieces and configured to join the mouthpieces; and
rein-connecting members provided substantially on outer ends of the mouthpieces and configured to respectively connect reins to the mouthpieces, wherein
the mouthpieces are each rotatable around the joint shaft member,
the joint shaft member is divided into right and left shaft elements at an intermediate portion thereof, and the shaft elements are rotatable toward the intermediate portion, and
each of the shaft elements includes a shaft portion and a joint portion formed at one end portion of the shaft portion, the shaft portion is mounted to the mouthpiece to be rotatable around an axis thereon and joint portions of the shaft elements are coupled to each other such that the shaft elements are rotatable toward the joint portion.

10. The horse bit according to claim 9, further comprising:
a joint pin member, wherein
each of the joint portions includes a ring-shaped portion, and
the shaft elements are rotatable around the pin member inserted substantially coaxially into the ring-shaped portions.

11. The horse bit according to claim 10, wherein the joint portions of the shaft elements are coupled to form a substantially spherical shape.

12. The horse bit according to claim 11, wherein the joint portions further include a pair of semispherical shells joined into a substantially spherical shell, and the semispherical shells are coupled by the pin member inserted substantially coaxially into the ring-shaped portions with the ring-shaped portions stored within the semispherical shells.

13. The horse bit according to claim 11, wherein the joint portion is semispherical.

14. The horse bit according to claim 11, wherein each of the shaft elements includes an eye bolt and a nut, and the mouthpiece has an inner cavity extending in an axial direction thereof, and
the inner cavity includes a bolt storage bore into which the eye bolt is rotatably inserted, and a nut storage bore extending continuously with the bolt storage bore and away from the joint portion and configured to store the nut screwed to the bolt, the nut storage bore having a diameter larger than a diameter of the bolt storage bore.

15. The horse bit according to claim 14, wherein each of the mouthpieces is formed by two members coupled in the vicinity of a boundary between the bolt storage bore and the nut storage bore.

16. The horse bit according to claim 14, wherein the intermediate mouthpiece is formed by three members joined in the vicinity of a boundary between the bolt storage bore and the nut storage bore.

17. The horse bit according to claim 14, wherein the intermediate mouthpiece is formed by two members joined in the nut storage bore.

18. The horse bit according to claim 9, wherein the mouthpieces are each rotatable relative to the joint shaft member without translational movement of either of the mouthpieces relative to the joint shaft member.

* * * * *